US005199213A

United States Patent [19]

Krebs et al.

[11] Patent Number: 5,199,213

[45] Date of Patent: Apr. 6, 1993

[54] CEMETERY PLANT POT

[76] Inventors: Sharon E. Krebs, 5919 Shope Pl.; Robert E. Fleck, 5920 Locust La., both of Harrisburg, Pa. 17109

[21] Appl. No.: 668,233

[22] Filed: Mar. 12, 1991

[51] Int. Cl.[5] ..... A47G 7/00

[52] U.S. Cl. ..... 47/39; 248/146; 248/27.8

[58] Field of Search ..... 248/27.8, 146, 311.2; 47/47, 41.1, 41.11, 41.13, 39

[56] References Cited

U.S. PATENT DOCUMENTS

| | | | |
|---|---|---|---|
| D. 149,171 | 4/1948 | Cohen | 248/146 |
| 585,931 | 7/1897 | Gridley | 47/39 |
| 905,627 | 12/1908 | Astruck | 248/146 |
| 949,535 | 2/1910 | Hamm | 248/146 |
| 1,448,808 | 3/1923 | McGowan | 47/41.1 |
| 1,609,246 | 11/1926 | Hamburger | 47/39 |
| 1,765,140 | 6/1930 | Fitl | 47/41.01 |
| 1,877,098 | 9/1932 | Washburn | 47/39 |
| 1,879,220 | 9/1932 | Harmony | 248/27.8 |
| 2,383,665 | 8/1945 | Malicay | 47/47 |
| 3,351,310 | 11/1967 | Turner | 248/27.8 |

*Primary Examiner*—David A. Scherbel
*Assistant Examiner*—Joanne C. Downs
*Attorney, Agent, or Firm*—Leon Gilden

[57] ABSTRACT

A plant pot structure is arranged for threaded securement within a threaded pedestal bore, wherein the apparatus includes a threaded disk threadedly receivable within the bore and the disk mounting a support rod orthogonally thereto in a coaxial relationship. The pot structure is mounted at an upper terminal end of the rod, wherein the pot structure is arranged to optionally include a lower conical base and a cylindrical base permitting directing of water flow into the pot mounted within the conical base.

2 Claims, 4 Drawing Sheets

CEMETERY PLANT POT

BACKGROUND OF THE INVENTION

1. Field of the Invention

The field of invention relates to plant support apparatus, and more particularly pertains to a new and improved cemetery plant pot wherein the same is arranged for mounting within a pedestal for positioning a plant within a cemetery environment.

2. Description of the Prior Art

Plant pots have been utilized in the prior art extensively, and particularly in the prior art has provided for the use of a support structure for plant pots as may be found for example in U.S. Pat. No. 4,522,366 to Howell wherein the support apparatus includes a locking plug to lock the pot to a support base.

U.S. Pat. No. 3,001,326 to O'Brien, et al. sets forth a cemetery base unit utilizing an exterior container mounting an interior container therewithin.

U.S. Pat. No. 3,142,934 to Mehling utilizes a plant holder for positioning on a tombstone member utilizing a resilient base mounting a plant within the support structure.

As such, it may be appreciated that there continues to be a need for a new and improved cemetery plant pot as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of plant holder apparatus now present in the prior art, the present invention provides a cemetery plant pot wherein the same utilizes a support disk mounting a rod, with a support container mounted at an upper terminal end of the rod for securing a plant pot within the container. As such, the general purpose of the present invention, which will be described subsequently in greater detail, is to provide a new and improved cemetery plant pot which has all the advantages of the prior art plant holder apparatus and none of the disadvantages.

To attain this, the present invention provides a plant pot structure arranged for threaded securement within a threaded pedestal bore, wherein the apparatus includes a threaded disk threadedly receivable within the bore and the disk mounting a support rod orthogonally thereto in a coaxial relationship. The pot structure is mounted at an upper terminal end of the rod, wherein the pot structure is arranged to optionally include a lower conical base and a cylindrical base permitting directing of water flow into the pot mounted within the conical base.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cemetery plant pot which has all the advantages of the prior art plant holder apparatus and none of the disadvantages.

It is another object of the present invention to provide a new and improved cemetery plant pot which may be easily and efficiently manufactured and marketed.

It is a further object of the present invention to provide a new and improved cemetery plant pot which is of a durable and reliable construction.

An even further object of the present invention is to provide a new and improved cemetery plant pot which is susceptible of a low cost of manufacture with regards to both materials and labor, and which accordingly is then susceptible of low prices of sale to the consuming public, thereby making such cemetery plant pots economically available to the buying public.

Still yet another object of the present invention is to provide a new and improved cemetery plant pot which provides in the apparatuses and methods of the prior art some of the advantages thereof, while simultaneously overcoming some of the disadvantages normally associated therewith.

Still another object of the present invention is to provide a new and improved cemetery plant pot wherein the same is arranged for mounting to a pedestal in a cemetery environment.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
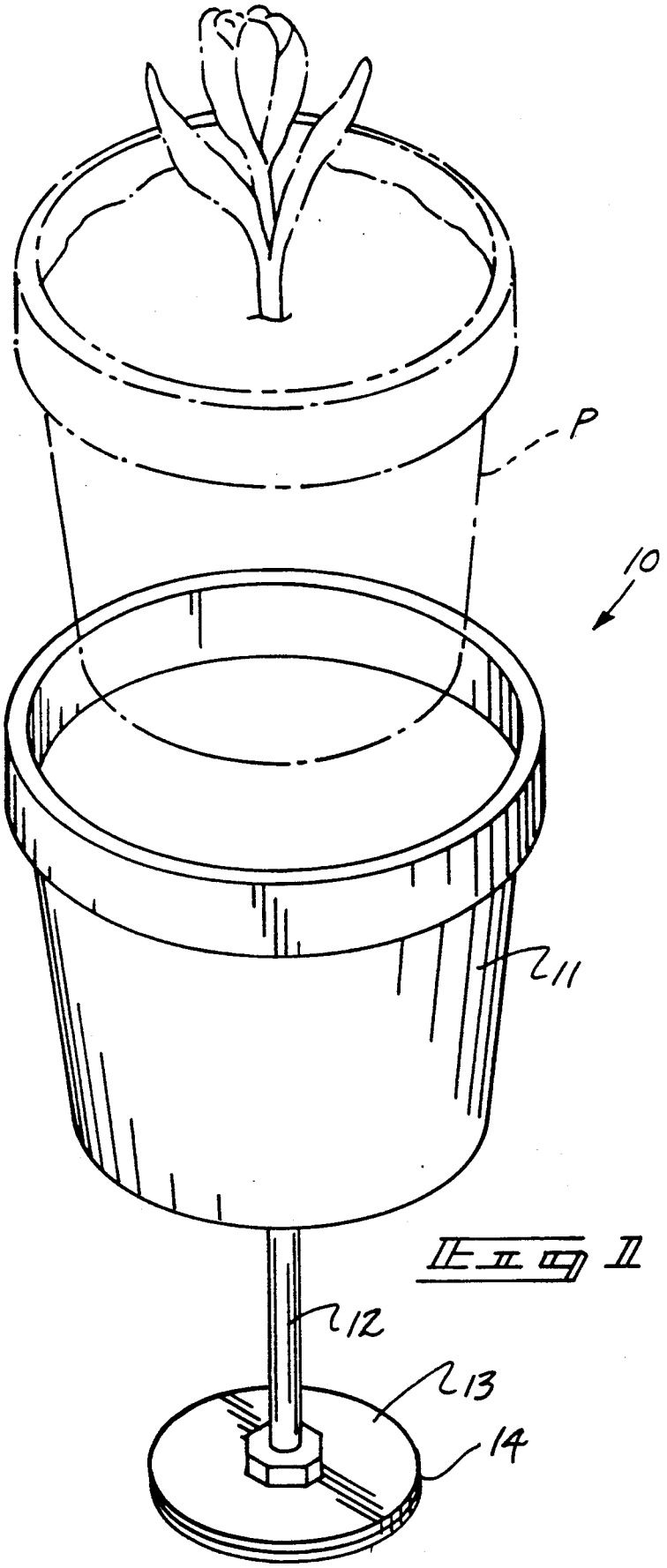
FIG. 1 is an isometric illustration of the instant invention.

With reference now to the drawings, and in particular to FIGS. 1 to 6 thereof, a new and improved cemetery plant pot embodying the principles and concepts of the present invention and generally designated by the reference numerals 10 and 10*a* will be described.

Figure 2:
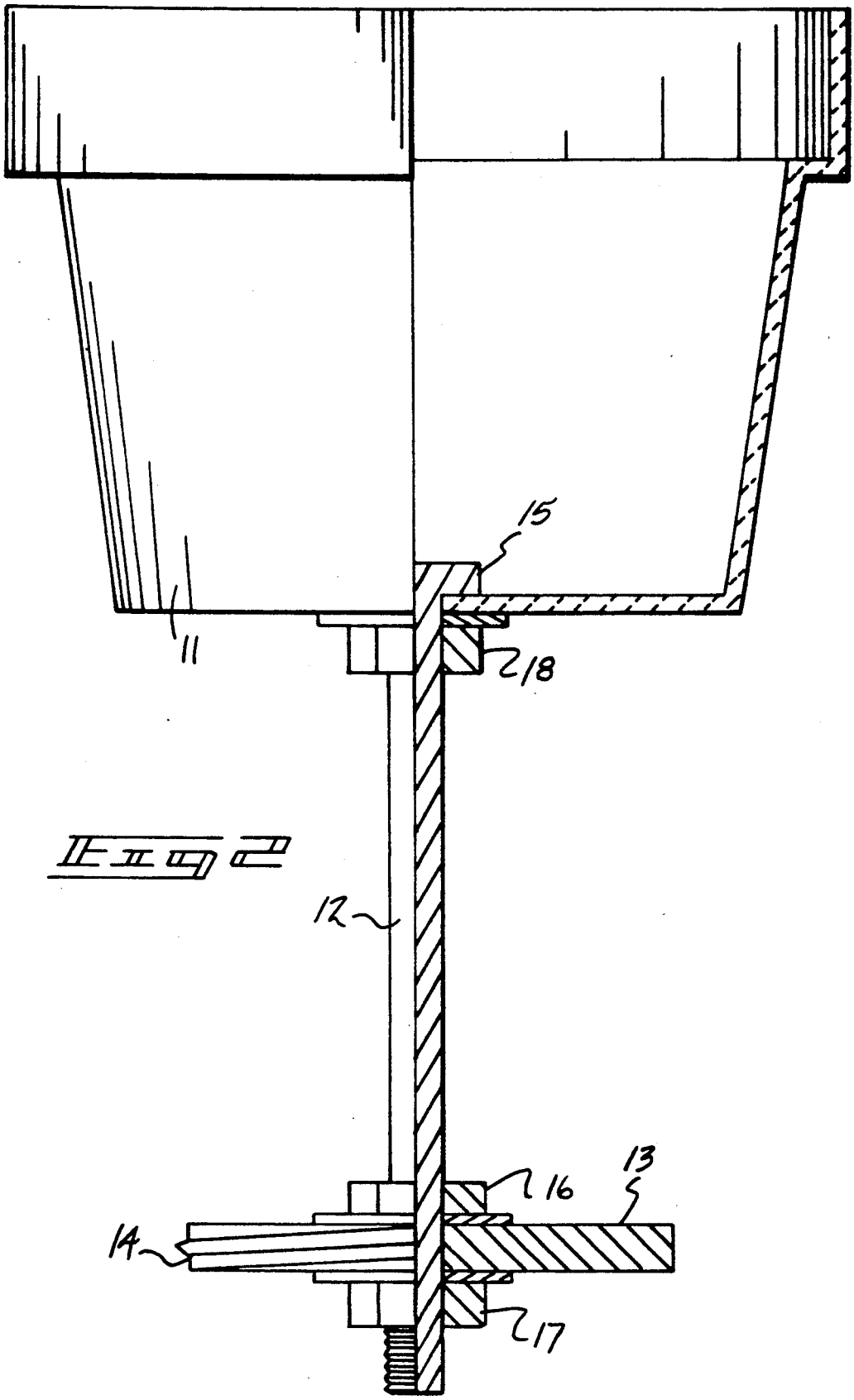
FIG. 2 is an orthographic view, partially in section, of the instant invention.
Figure 3:
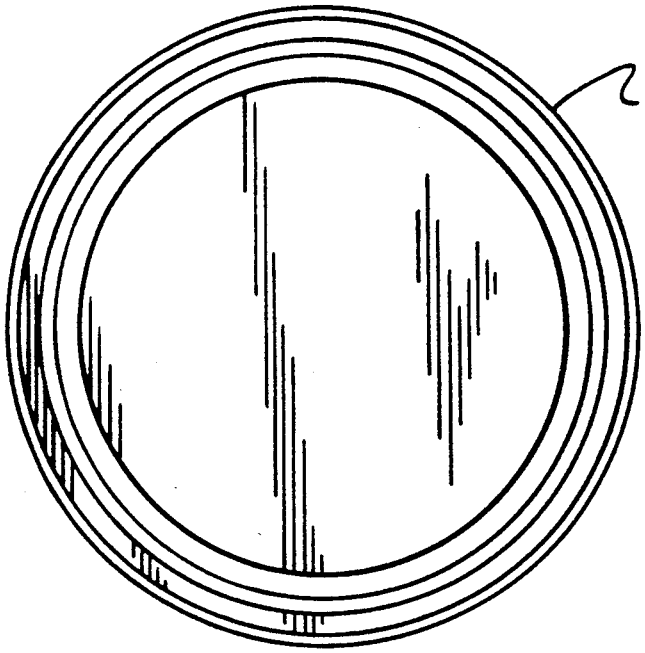
FIG. 3 is an orthographic top view of the instant invention.
Figure 4:
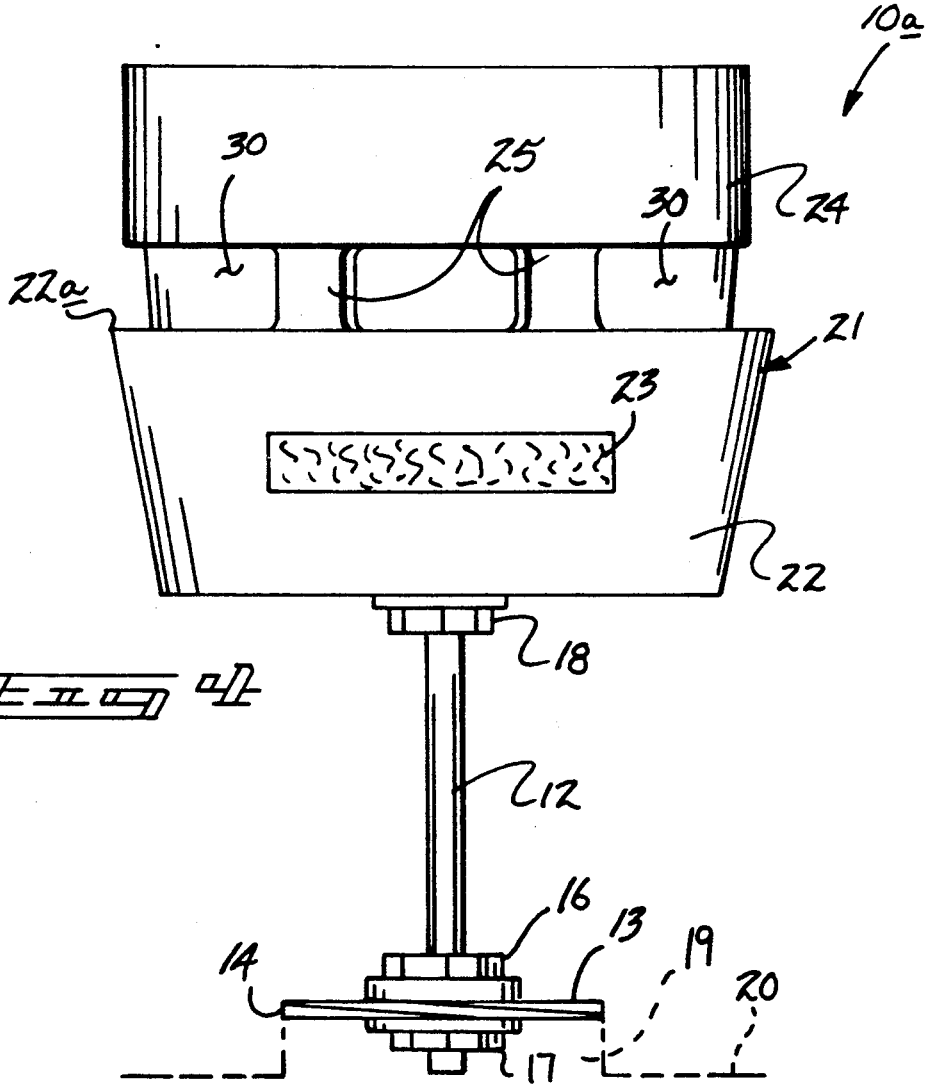
FIG. 4 is an orthographic side view of a modified plant pot holder as set forth by the instant invention.
Figure 5:
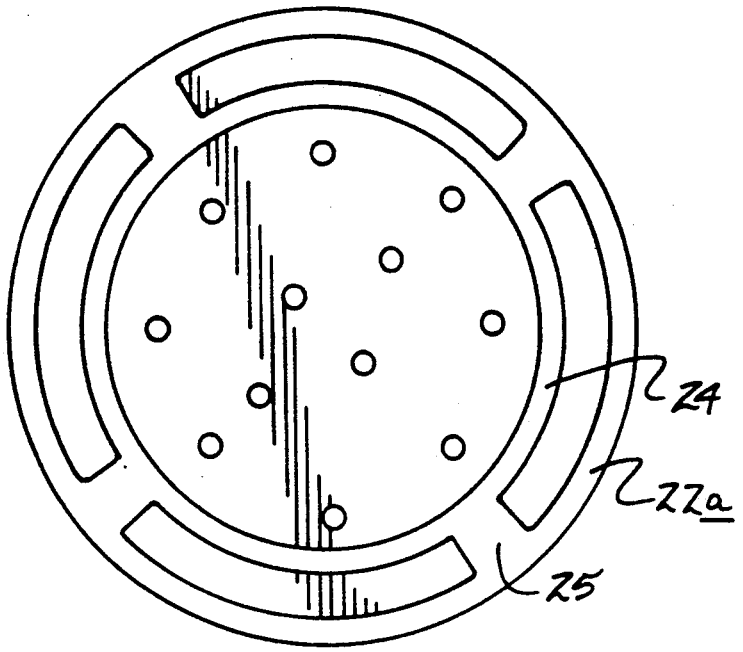
FIG. 5 is an orthographic top view of the modified plant pot as utilized by the instant invention.

More specifically, the cemetery plant pot 10 of the instant invention essentially comprises a conical pot hanger 11, with a planar floor mounting a support rod 12 coaxially of the conical pot container 11 at an upper terminal end of the support rod 12. A container fastener 18 captures the floor of the pot container 11 between the fastener 18 and a support rod head 15, as illustrated in FIG. 2 for example. A lower terminal end of the support rod 12 is coaxially and orthogonally mounted through a cylindrical mounting disk 13, including a threaded external side wall 14 that is threadedly received within an internally threaded pedestal bore 19 of an associated pedestal support 20, as illustrated in FIG. 4 for example. Upper and lower disk fasteners 16 and 17 are positioned on opposed sides of the mounting disk 13 to fixedly secure the disk to and adjacent the lower terminal end of the support rod 12.

Figure 6:
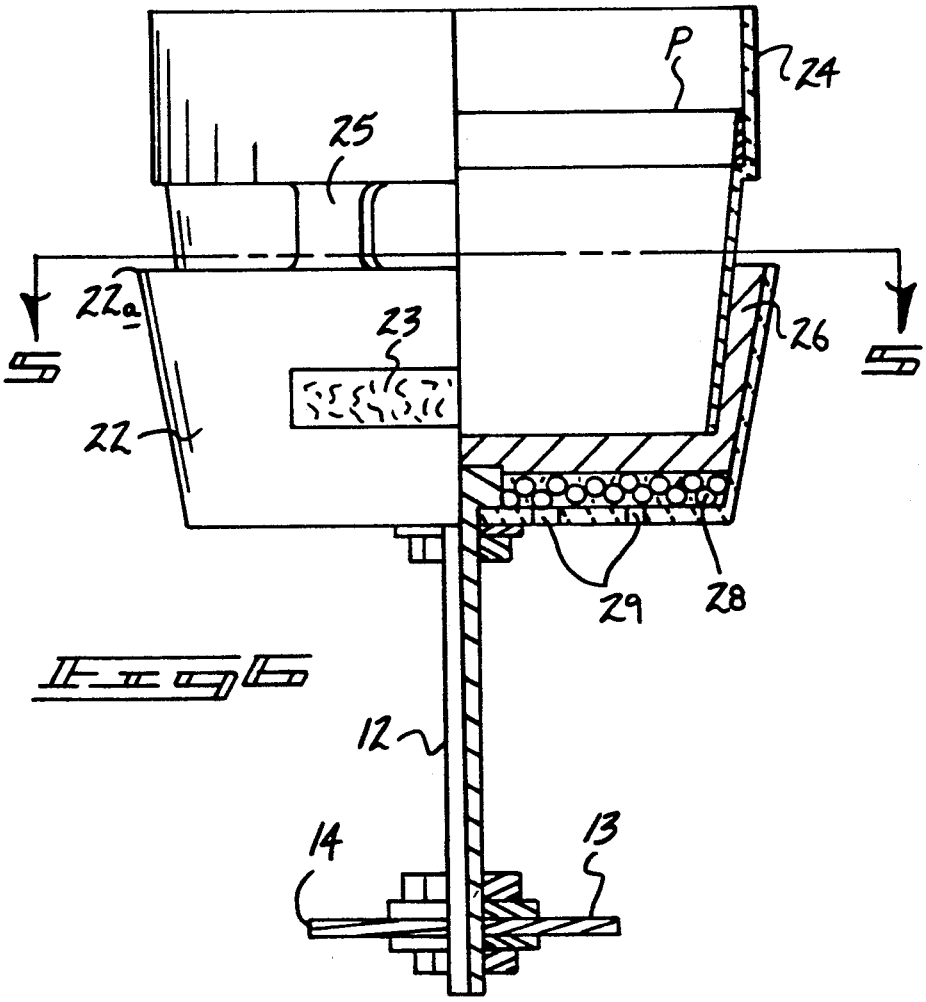
FIG. 6 is an orthographic side view, partially in section, of the plant pot utilized by the instant invention.

A modified container 21, as illustrated in FIG. 4, setting forth a modified cemetery plant pot 10*a*, includes a truncated conical base 22 whose planar floor mounts the support rod 12, in a manner as described with reference to the embodiment of FIGS. 1 and 2. The conical base 22 is defined by an upper annular rim 22*a* defined by a predetermined first diameter. A fibrous water transmissible indicator strip 23 is directed through the side wall of the conical lower base 22. Reference to FIG. 6 illustrates the use of a fluid absorbent layer 26 mounted coextensively through an interior surface of the lower base 22. A cylindrical upper base 24 is mounted coaxially aligned with and spaced above the lower base 22 and is defined by a predetermined second diameter less than the first diameter to define a plurality of windows 30 formed by connecting webs 25 between the lower base and upper base. The windows permit rain water and the like to be directed into the lower base for self-watering of the pot "P" contained within the modified container 21. A gravel base 28 is positioned overlying the floor of the lower base 22 utilizing drain apertures 29 to remove excess fluid therefrom.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention .

What is claimed as being new and desired to be protected by Letters Patent of the United States is as follows:

1. A cemetery plant pot apparatus comprising, in combination.

a truncated conical lower base container, the lower base container including a planar floor, and a support rod mounted coaxially and orthogonally relative to the planar floor, and the support rod including a support rod head positioned within the lower base, and a container fastener mounted about the support rod capturing the planar floor between the container fastener and the support rod head, and the support rod including a lower terminal end, and a cylindrical mounting disk secured to the support rod adjacent the lower terminal end, and the mounting disk including an externally threaded cylindrical side wall for mounting of the disk within an internally threaded pedestal bore, and the conical lower base includes an upper annular rim defined by a predetermined first diameter, and a cylindrical upper base coaxially aligned with the conical lower base, with the cylindrical upper base spaced above the lower base and defined by a predetermined second diameter less than the predetermined first diameter, and a plurality of protecting webs securing the cylindrical upper base to the upper annular rim defining a plurality of windows between the upper base, the lower base, and the connecting webs to permit directing of irrigation fluid through the windows.

2. An apparatus as set forth in claim 1 including a fibrous water transmissible indicator strip directed through the lower base spaced above the planar floor, wherein the indicator strip is in fluid communication with a fluid absorbent layer, the fluid absorbent layer is coextensively mounted within the lower base.

* * * * *